US006773329B2

(12) United States Patent
Hornsby et al.

(10) Patent No.: US 6,773,329 B2
(45) Date of Patent: Aug. 10, 2004

(54) AMUSEMENT DEVICE INCLUDING A THEMATIC PLAY SET

(75) Inventors: James R. Hornsby, St. Louis, MO (US); Joseph L. McGowan, St. Charles, MO (US); Chad P. Stuemke, St. Louis, MO (US); David B. Midgett, Sulpher Springs, MO (US)

(73) Assignee: All Season Toys, Inc., Malibu, CA (US)

( * ) Notice: Subject to any disclaimer, the term of this patent is extended or adjusted under 35 U.S.C. 154(b) by 0 days.

(21) Appl. No.: 09/968,597

(22) Filed: Oct. 1, 2001

(65) Prior Publication Data

US 2002/0098773 A1 Jul. 25, 2002

Related U.S. Application Data

(60) Provisional application No. 60/237,478, filed on Oct. 2, 2000.

(51) Int. Cl.[7] ..... A63H 33/30

(52) U.S. Cl. ..... 446/475; 446/476; 446/37; 446/219

(58) Field of Search ..... 446/475, 476, 446/477, 478, 486, 398, 399, 400, 219, 34, 36–39, 43, 45, 485, 487, 236; 40/447, 442

(56) References Cited

U.S. PATENT DOCUMENTS

| | | | | | |
|---|---|---|---|---|---|
| 296,941 | A | * | 4/1884 | Diener | |
| 842,659 | A | * | 1/1907 | Haverman | |
| 3,609,343 | A | * | 9/1971 | Howlett | |
| 4,055,840 | A | * | 10/1977 | Uchytil et al. | 340/321 |
| 4,139,967 | A | * | 2/1979 | Kuna et al. | |
| 4,209,938 | A | * | 7/1980 | Orenstein | |
| 4,729,748 | A | | 3/1988 | Van Ruymbeke | |
| 4,924,358 | A | * | 5/1990 | Von Heck | 362/32 |
| 5,163,861 | A | | 11/1992 | Van Ruymbeke | |
| 5,344,156 | A | * | 9/1994 | Levin | 273/355 |
| 5,460,561 | A | * | 10/1995 | Dahlgren | 446/117 |
| 5,525,086 | A | * | 6/1996 | Gentile et al. | 446/41 |
| 6,056,623 | A | * | 5/2000 | Arriola | 446/476 |
| 6,106,356 | A | * | 8/2000 | Trageser | 446/72 |
| 6,260,989 | B1 | * | 7/2001 | Ingraselino | 362/383 |

* cited by examiner

*Primary Examiner*—Jacob K. Ackun
*Assistant Examiner*—Jamila O Williams
(74) *Attorney, Agent, or Firm*—Dorsey & Whitney LLP

(57) ABSTRACT

A thematic play set that in one example is in the form of a castle includes a plurality of turrets. Some turrets have end caps that may be removed to allow fiber optic bundles to be exposed that simulate a fireworks bloom. Another turret includes a launcher that launches a winged figurine into the air to simulate flight. The play set includes a number of accessories and features that add to the theme established.

42 Claims, 16 Drawing Sheets

AMUSEMENT DEVICE INCLUDING A THEMATIC PLAY SET

CROSS-REFERENCE TO RELATED APPLICATION

This application claims priority from Provisional Application No. 60/237,478, dated Oct. 2, 2000.

FIELD OF THE INVENTION

The present invention relates to amusement devices. More specifically, the present invention relates to thematic play sets.

BACKGROUND OF THE INVENTION

Children enjoying playing with toys that facilitate their creativity and imagination. One such toy that has commonly used by children for some time is a thematic play set. For example, a doll house is a type of thematic play set wherein a child may fantasize with dolls or other characters who inhabit or utilize the doll house.

Sometimes these play sets serve certain utilitarian purposes. For example, the above doll house may serve as a storage container for the dolls or other play elements when not in use. Thematic play sets can be quite ornate and may include decorative elements to define a given theme. For example, the doll house may be crafted to look like an elegant home having components simulating their real-life counterparts. Thus, various designs exist for such play sets that revolve around their utilitarian and decorative aspects.

BRIEF SUMMARY OF THE INVENTION

The present invention provides for a thematic play set having one or more functional characteristics to enhance the visual appearance of the play set, the functional options provided to the user may allow specific actions to occur, and/or provide additional whimsical or fanciful roles for the user to engage in.

In one embodiment, the present invention includes a castle play set. The castle includes one or more turrets that are removable to reveal functional accessories. One accessory is a launcher to which a doll or other character or toy may be affixed. The launcher is then capable of launching the doll or toy into the air to simulate the character flying. Another accessory may be a plurality of fiber optic strands that can be illuminated and extended through the exposed turret to simulate a bloom of fireworks. Additionally, various trinkets, toys or accessories may be provided within the castle to correspond with the theme provided. The trinkets, toys or accessories may be provided with or within the castle. In addition, various "secret" or hidden compartments can be provided to contained trinkets, toys or accessories.

In one embodiment, the present invention is a play set having a thematic structure with a fireworks simulation and a launcher. In one embodiment, the thematic structure is a castle and the castle has a turret having a removable cap and a shaft. A fiber optic bundle is located within the shaft and is moveable so that at least a portion of the fiber optic bundle is external to the shaft. The play set may further include a light source coupled with the fiber optic bundle. A contact switch may be positioned within the shaft and may be engageable through movement of the fiber optic bundle to engage the light source.

In one embodiment, the play set may further include a lever coupled with the fiber optic bundle and external to the shaft so that movement of the lever causes movement of the fiber optic bundle.

In one embodiment, the play set includes a turret and the launcher forms a portion of the turret. The launcher may include a wind up mechanism for storing energy to launch an object away from the play set. The launcher may also include a foot peg holder for receiving the object. In one embodiment, the wind up mechanism includes at least one spring to cause the wind up mechanism to spin or rotate the object.

In one embodiment, the play set includes a gravity pin located within the turret which prevents the foot peg holder from receiving the object if the turret is not approximately vertically aligned.

In one embodiment, the launcher includes an activation mechanism. The activation mechanism may include an IR transmitter and an IR receiver, wherein the IR receiver is coupled with the launcher. The play set may also include a wand wherein the wand houses the IR transmitter.

In one embodiment the present invention is a play set having a thematic structure and a tubular shaft coupled with the structure and integrated with the theme. The play set also includes a fiber optic bundle, including flexible fibers, moveable from a first position wherein the fiber optic bundle is substantially contained within the tubular shaft to a second position wherein a substantial portion of the fiber optic bundle is outside of the tubular shaft.

In one embodiment, the present invention is a play set having a thematic structure and a launching mechanism coupled with the thematic structure. The launching mechanism includes a receiving slot for receiving a launchable object; a wind up mechanism for storing energy to launch the object; and an activation mechanism for causing the wind up mechanism to launch the object.

While multiple embodiments are disclosed, still other embodiments of the present invention will become apparent to those skilled in the art from the following detailed description, wherein is shown and described only the embodiments of the invention, by way of illustration, of the best modes contemplated for carrying out the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1:
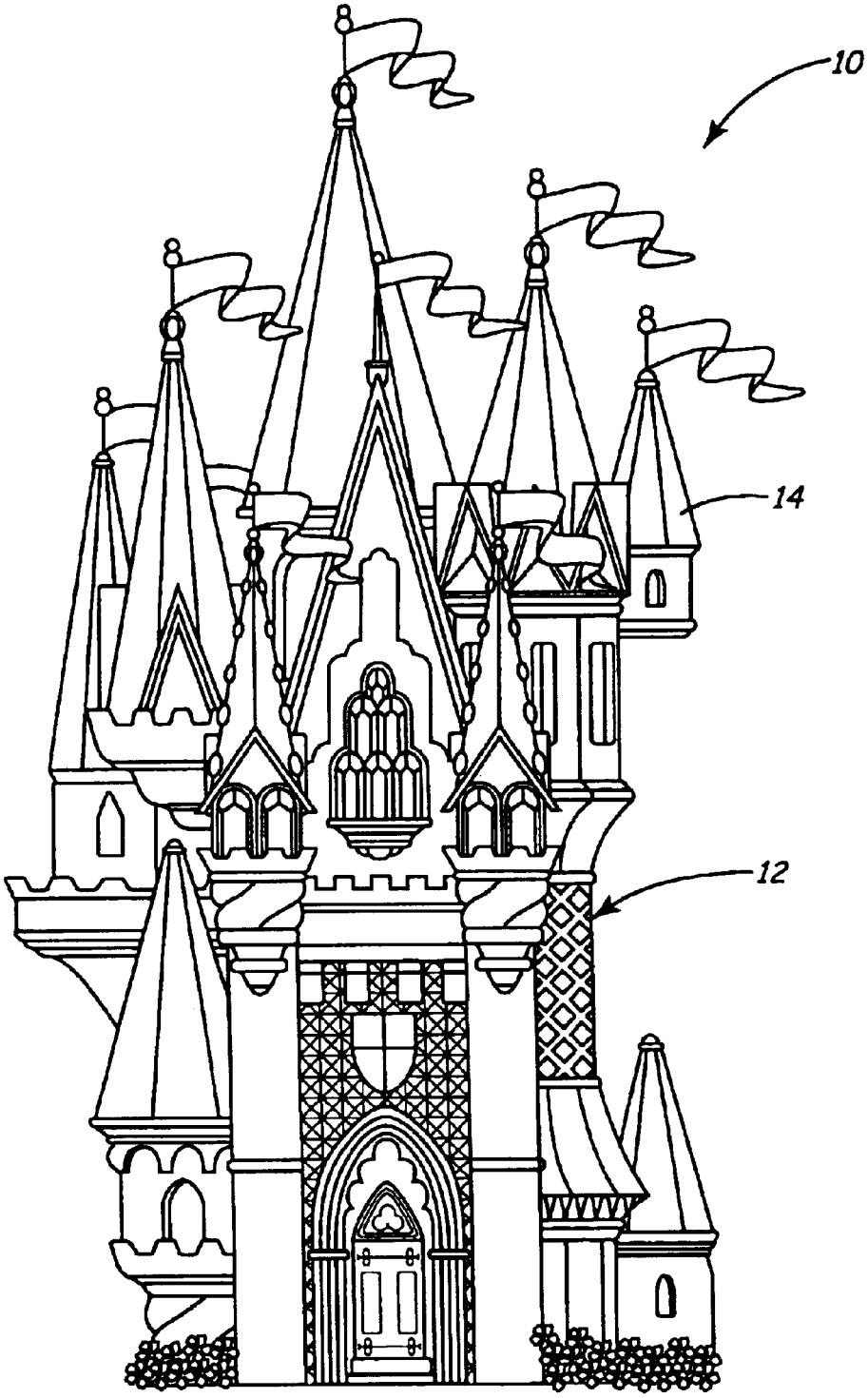
FIG. 1 is a front elevational view of a thematic play set consistent with the principals of the present invention.

Referring to FIG. 1, a thematic play set 10 is illustrated having the theme and form of castle 12. Thematic play set 10 includes a structure such as castle 12 that has a shape and various decorative elements such as doors, windows and textures to define it, for example, as a medieval type castle. The particular theme selected can vary and it is to be understood that the castle theme is for illustrative purposes only. Castle 12 includes a plurality of turrets 14. Turrets 14, in this theme, serve a dual purpose of decoratively fitting into the theme, and as will be explained in greater detail, also provide for certain of the functional features of play set 10.

Figure 2:
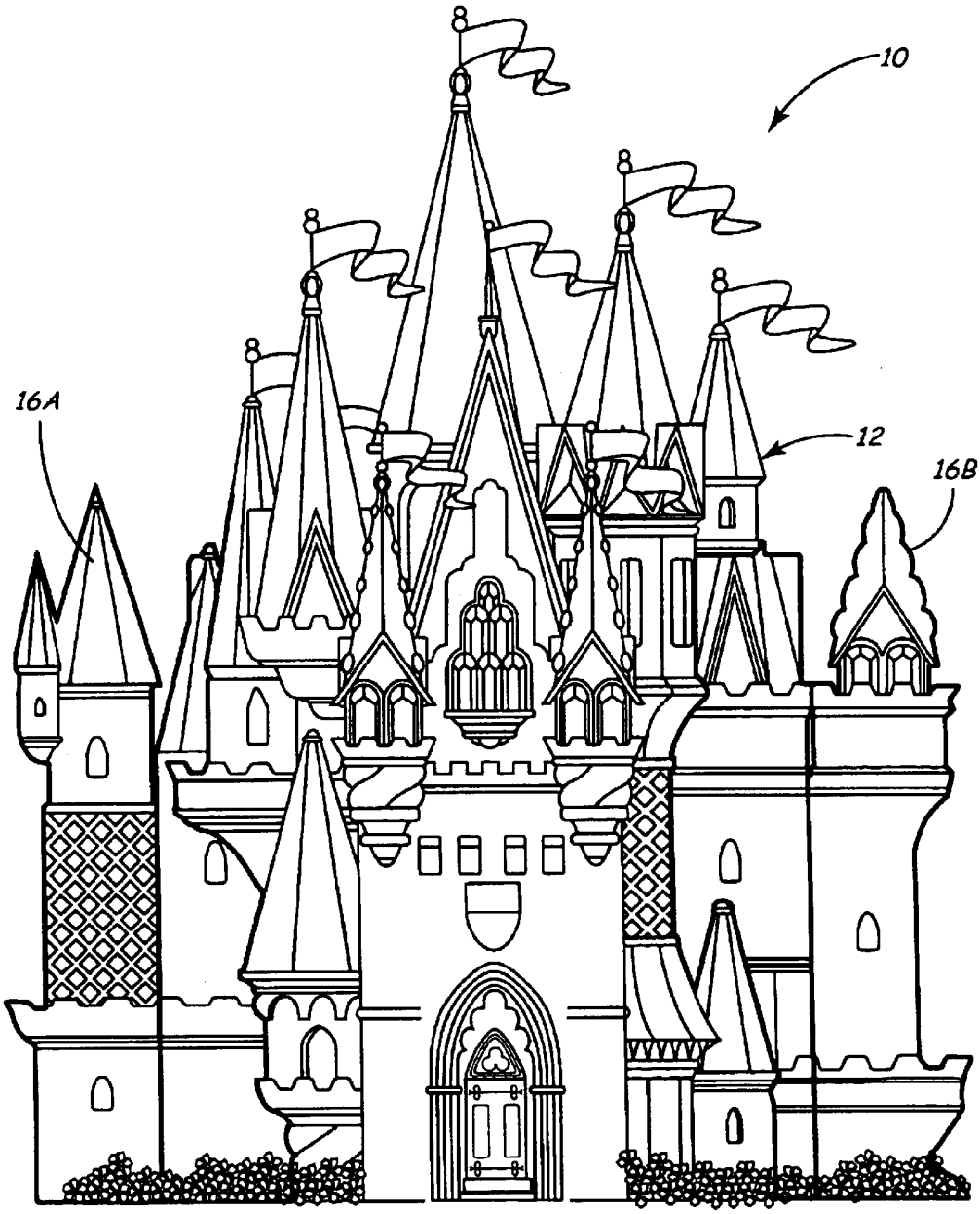
FIG. 2 is a front elevational view of a thematic play set having extended side panels, consistent with the principals of the present invention.

As illustrated in FIG. 1, play set 10 is a three dimensional structure that may include accessible interior portions. FIG. 2 illustrates how play set 10 can be expanded by introducing one or more side panels 16A, 16B (collectively 16). Side panels 16 can be relatively thin elements that attach to castle 12 to increase the overall size of play set 10. Alternatively, side panels 16 could be more elaborate three dimensional structures.

Figure 3:
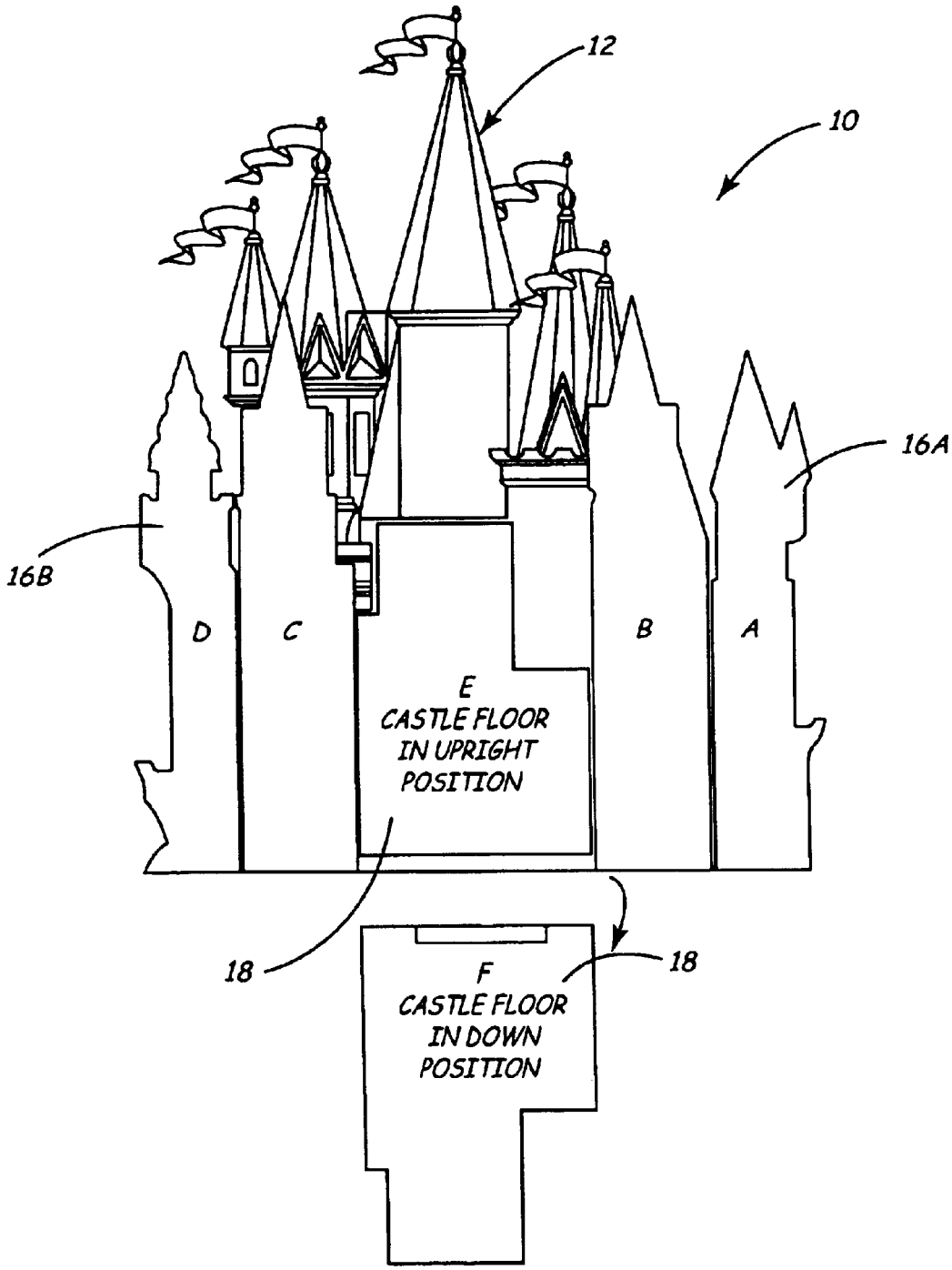
FIG. 3 is a rear elevational view of a thematic play set illustrating a floor portion moveable between an upper and a lower position, consistent with the principals of the present invention.

FIG. 3 is a rear schematic illustration showing panel 16 coupled with castle 12. In addition, castle floor 18 is illustrated in both an upright and a schematically lowered position. Castle floor 18, when lowered provides a surface area for play and may also provide access to the interior of castle 12.

Figures 4A, 4B, 4C:
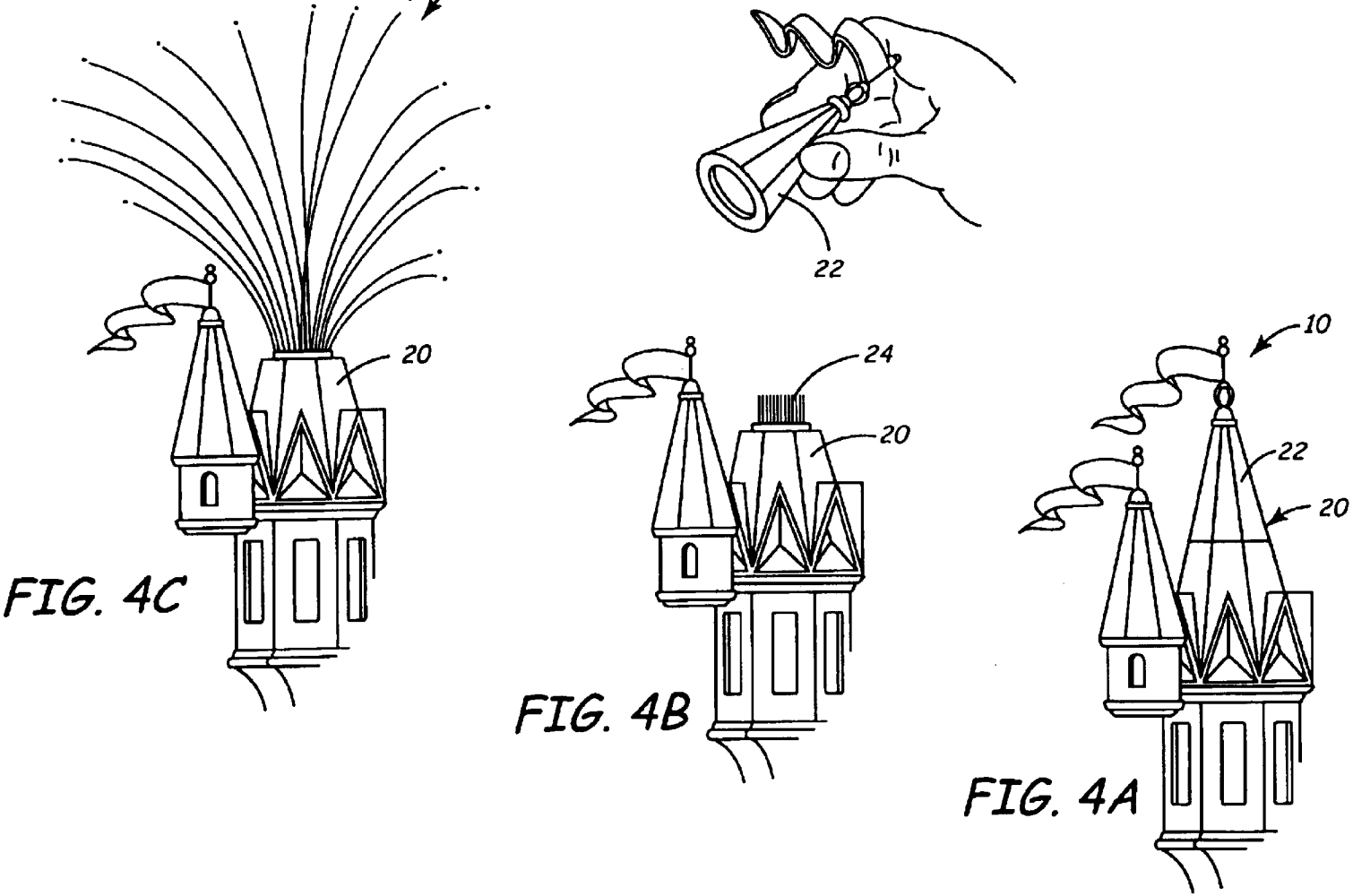
FIGS. 4A–4C illustrate a turret and extendable fiber optic bundle. consistent with the principals of the present invention.

One feature of play set 10 is the ability to simulate a fireworks display or bloom. FIGS. 4A–4C illustrate the simulation of fireworks. Turret cap 22 is originally positioned to form a portion of turret 20. The operator removes turret cap 22, revealing a portion of a fiber optic bundle 24 protruding from turret 20. To simulate the fireworks bloom, the operator raises fiber optic bundle 24 thus exposing more of fiber optic bundle 24. Fiber optic bundle 24, either through a natural flexibility or due to a pre-bending of the fibers, bend or flex away from vertical alignment (as illustrated) to effectively "bloom". Fiber optic bundle 24 is coupled with a light source and the exposed ends of fiber optic bundle 24 emit light. When positioned as illustrated in FIG. 4C, this arrangement simulates fireworks. Alternatively, reflective, colored, or otherwise decorative fibers could be used with or without a light source. When completed, the operator reinserts fiber optic bundle 24 into turret 20 and replaces turret cap 22 on turret 20. Any number of turrets can be provided with the simulated fireworks feature.

Figure 5:
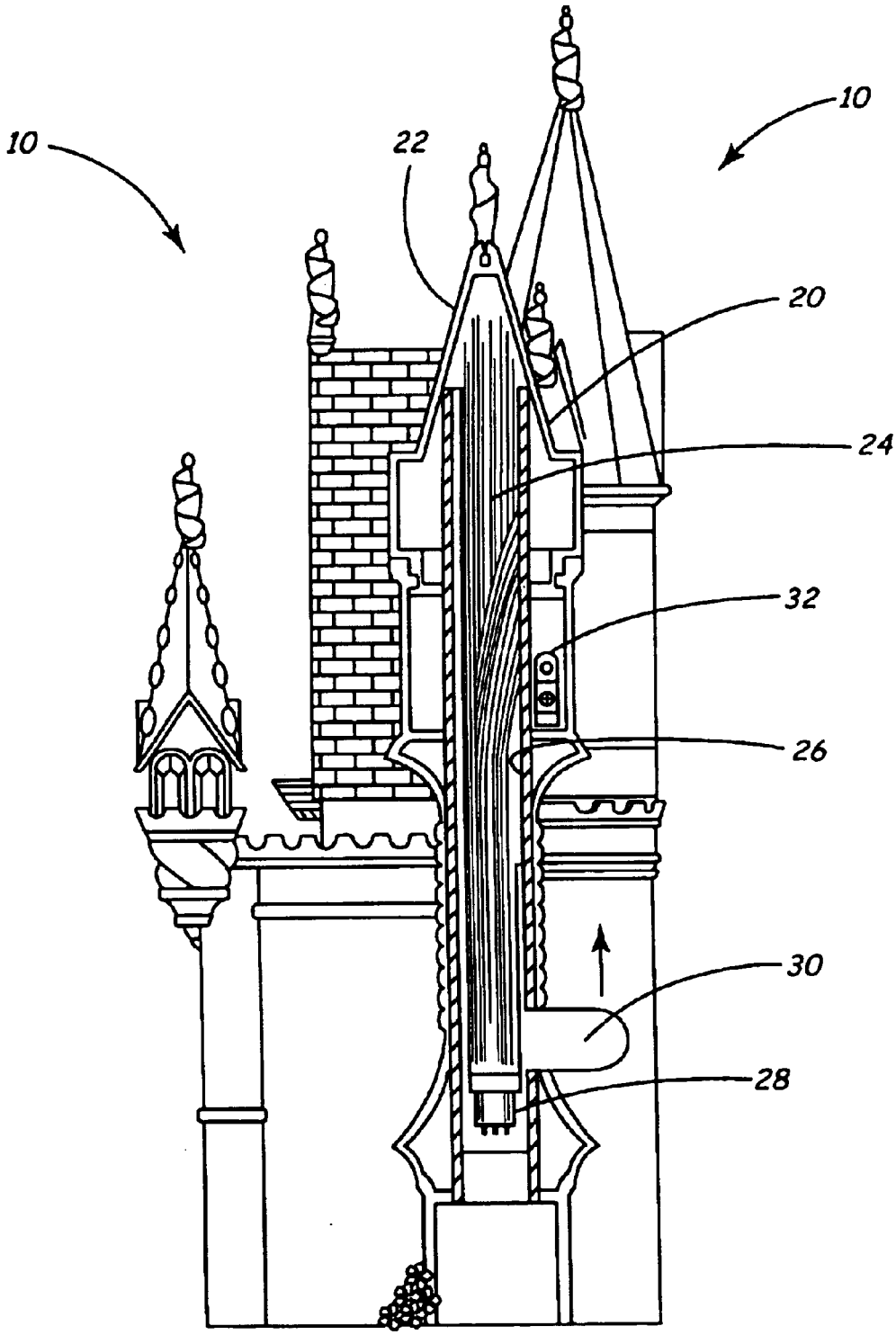
FIG. 5 is a partially sectional view illustrating the retention of an extendable fiber optic bundle, consistent with the principals of the present invention.
Figure 6:
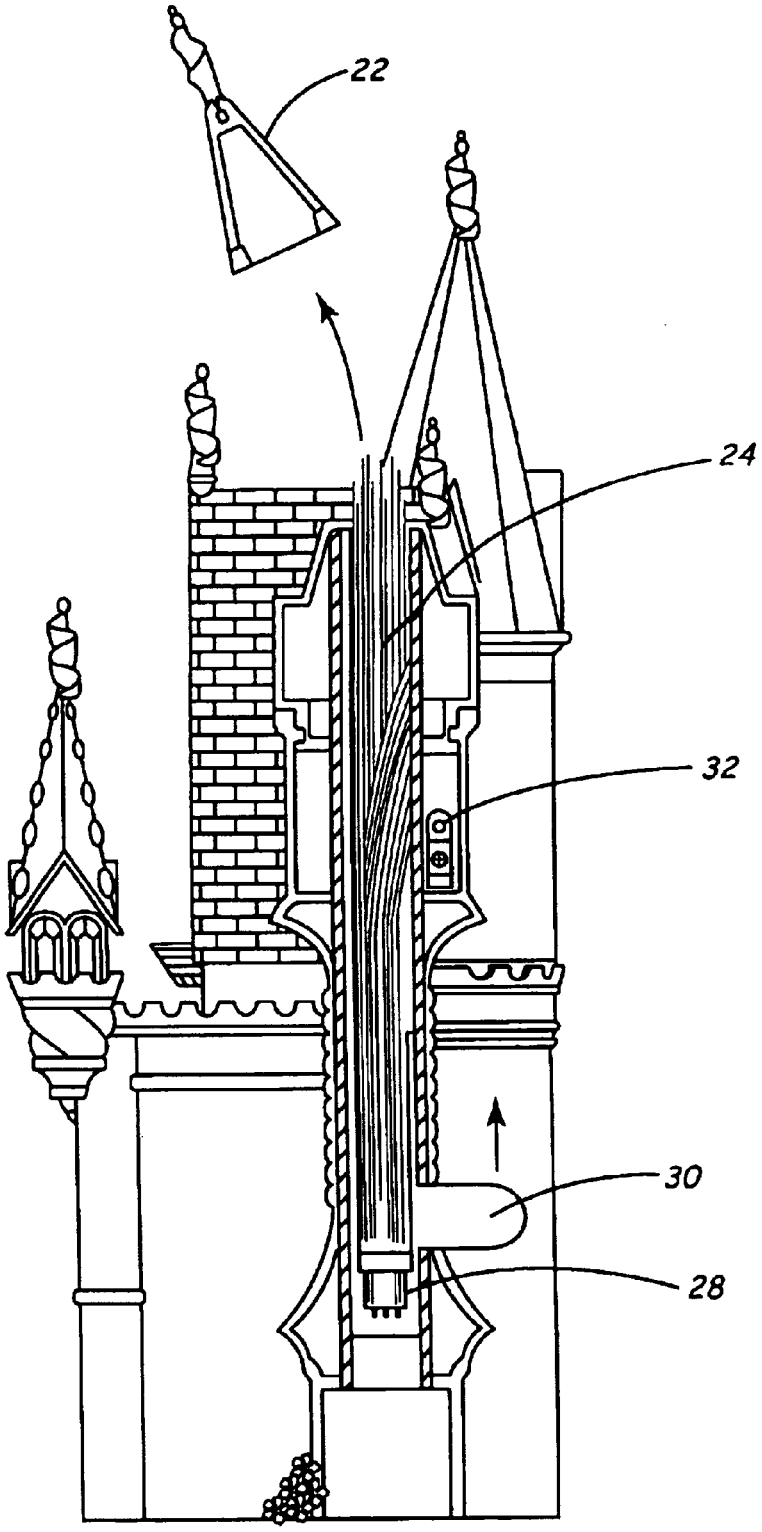
FIG. 6 is a partially sectional view illustrating the retention of an extendable fiber optic bundle, consistent with the principals of the present invention.
Figure 7:
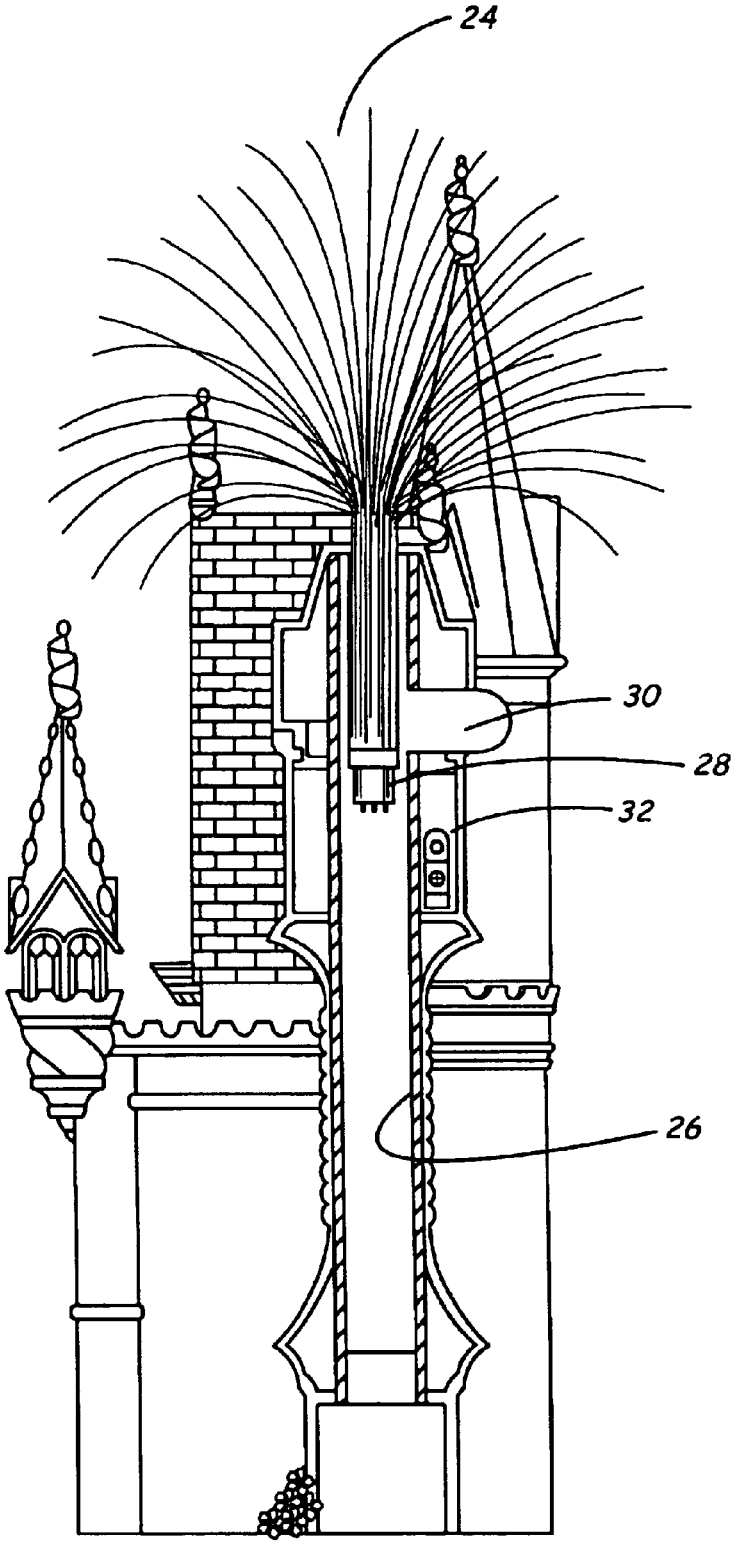
FIG. 7 is a partially sectional view illustrating the retention of an extendable fiber optic bundle, consistent with the principals of the present invention.

FIG. 5 is a side partially sectional view illustrating the stored position of fiber optic bundle 24 within a shaft 26 that is aligned with turret 20. Referring to FIG. 6, the operator removes turret cap 22. The operator then engages lever 30 which is coupled with fiber optic bundle 24. As lever 30 is raised, fiber optic bundle 24 is likewise raised, as illustrated in FIG. 7. As this occurs, contact switch 32 is caused to close thus allowing power to be delivered from an appropriate power source to light source 28 which is coupled to a lower portion of fiber optic bundle 28. Conversely, as lever 30 is lowered contact switch 32 is opened and fiber optic bundle 24 is retracted.

Figure 8:
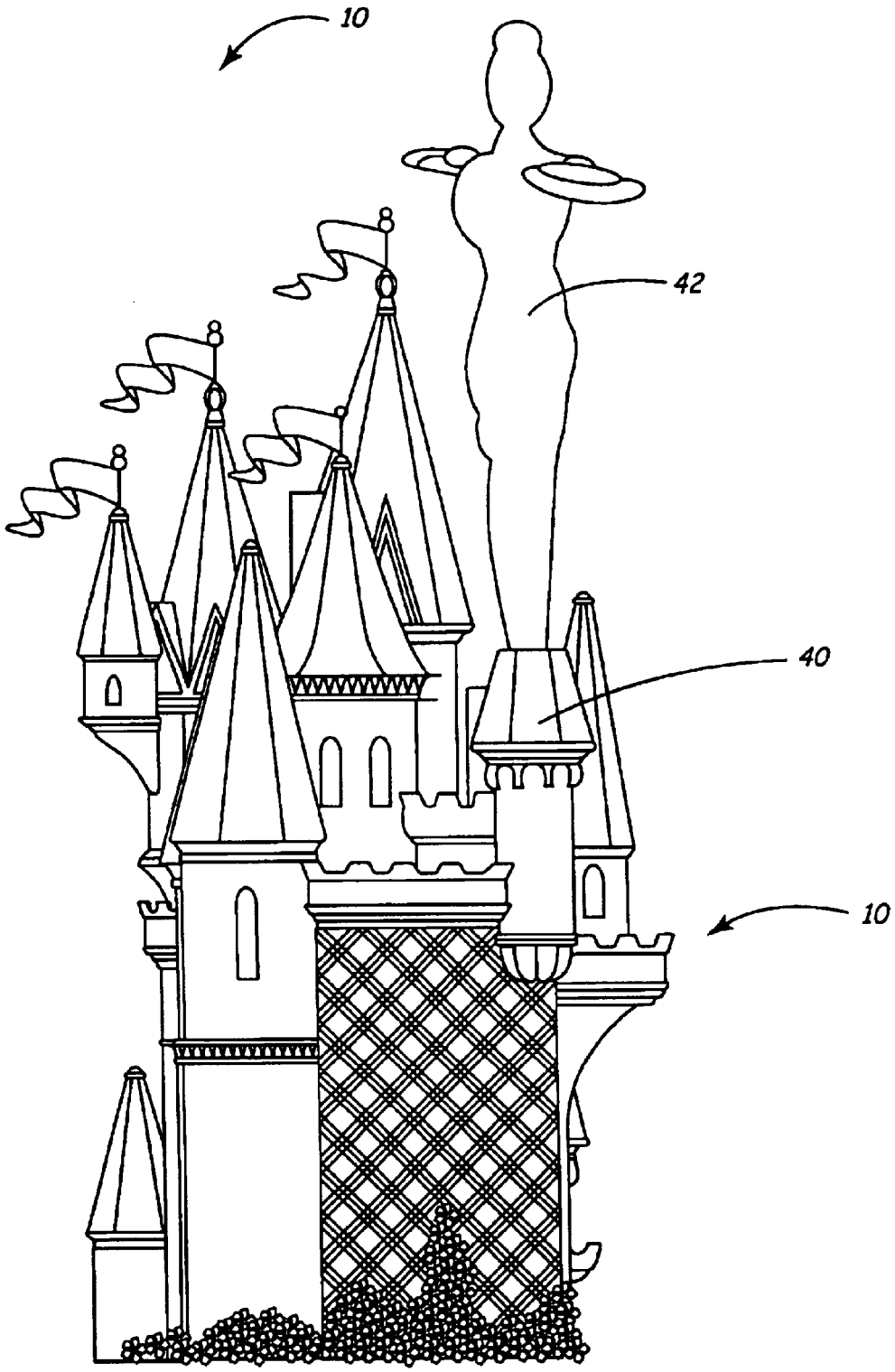
FIG. 8 is a front elevational view illustrating a thematic play set having a doll coupled with an integrated launcher, consistent with the principals of the present invention.

FIG. 8 is a side elevational view of play set 10 having a removable figurine 42 attached thereto. Figurine 42 can take any appropriate shape such as a person, animal, fictional or whimsical character, or any other object. As illustrated, figurine 42 is a "princess" that is consistent with the overall exemplary castle theme. Figurine 42 may be launched into the air from a launch turret 40 coupled with play set 10. Launch turret 40 can either be integral with play set 10 or may be removable component allowing figurine 42 to be launched from anywhere.

Figure 9:
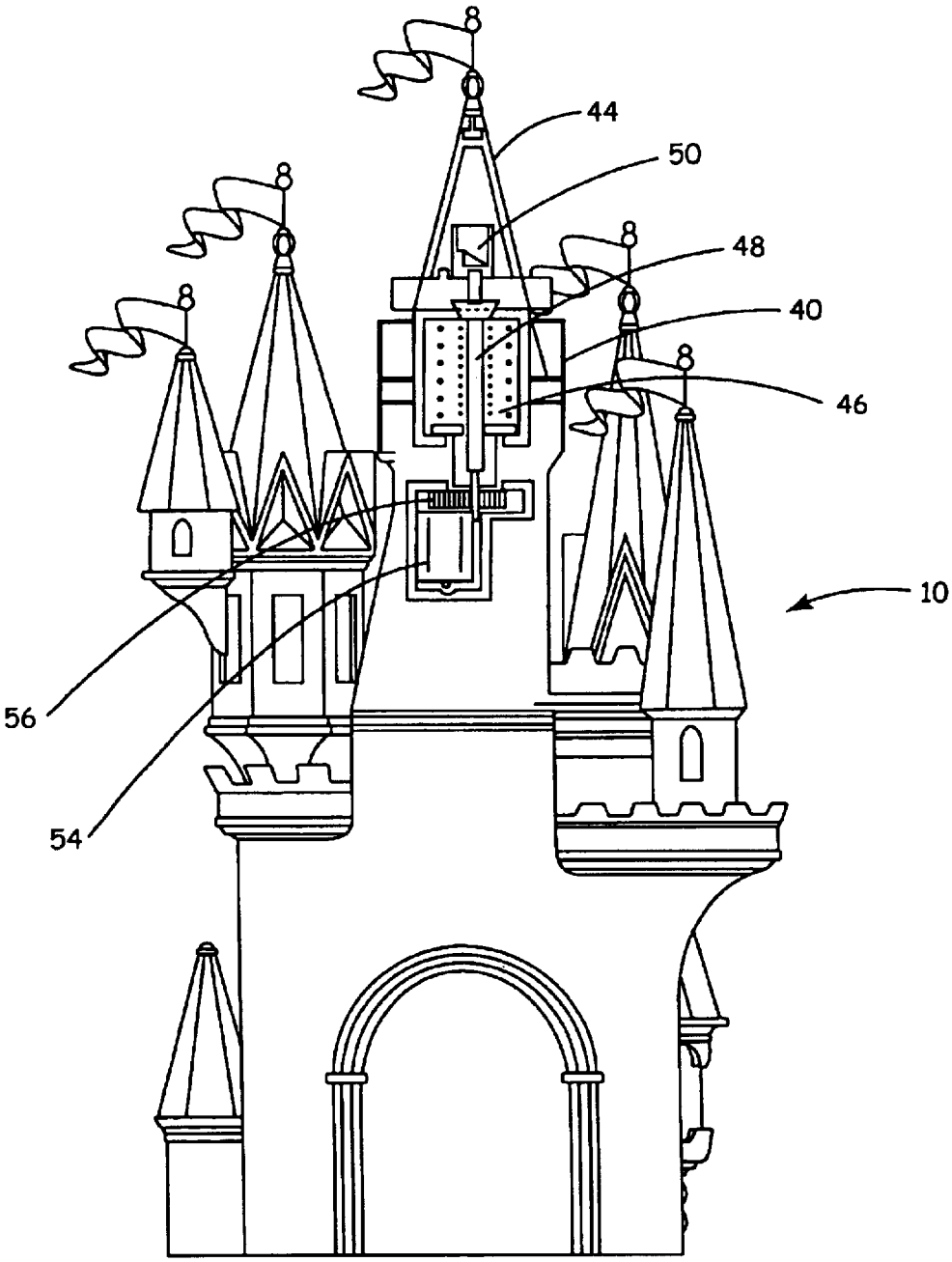
FIG. 9 is a front, partially sectional view of a thematic play set illustrating a launching mechanism, consistent with the principals of the present invention.

FIG. 9 is a side, partially sectional elevational view illustrating launch turret 40. A removable launch turret cap 44 conceals a foot peg holder 50 configured to receive and engage a portion of figurine 42. A wind up mechanism 46 is provided to impart rotational an/or vertical force to figurine 42 to simulate flight. Wind up mechanism 46 includes a wind up shaft 48 and spring 52. An optional motor 54 and transfer gear 56 may be provided to engage wind up mechanism 46. If no motor is provided, the operator manually compresses spring 52 and/or rotates shaft 48.

Figure 10A:
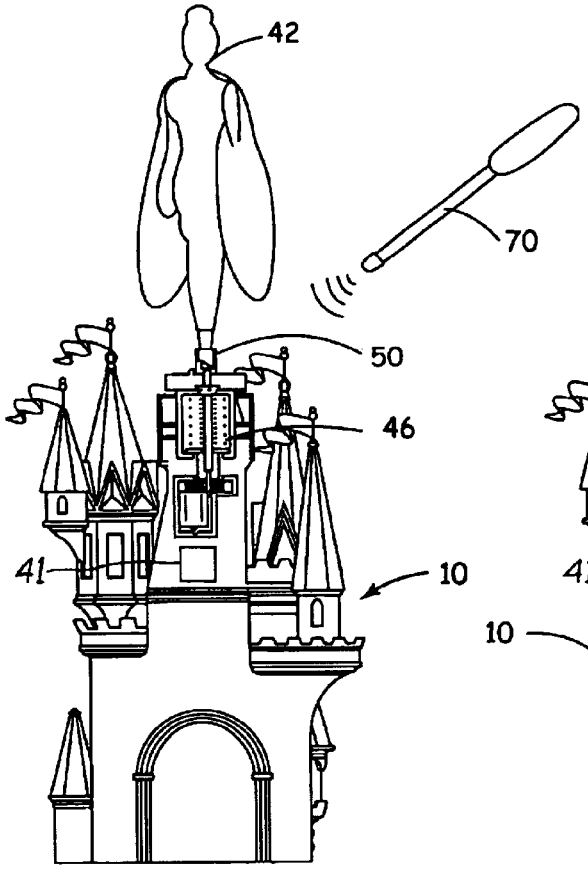
FIGS. 10A–10B illustrate the launching of a doll from the thematic play set, in accordance with the principals of the present invention.
Figure 10B:
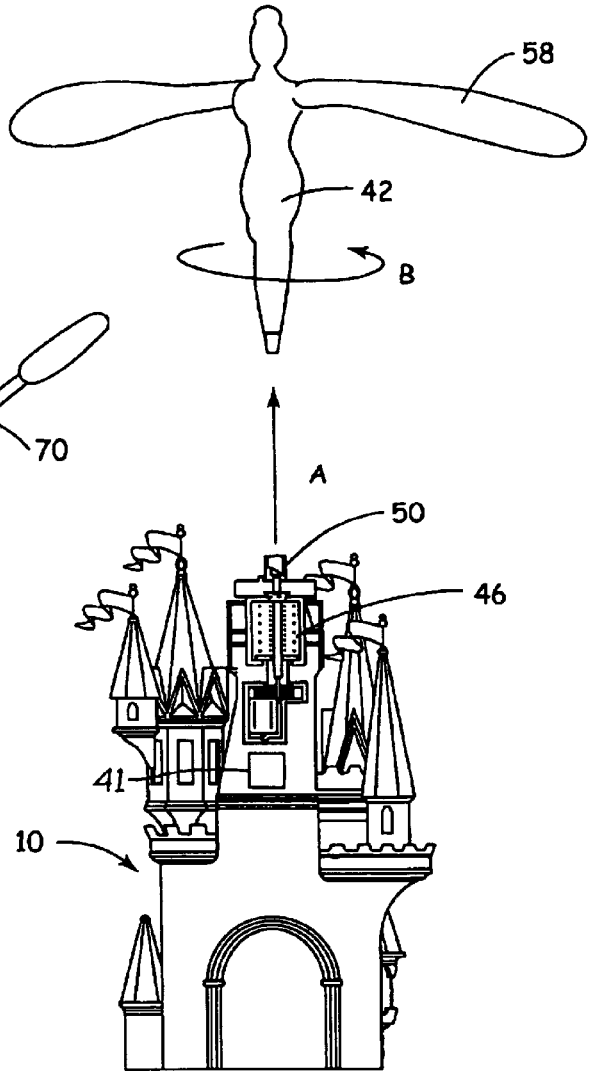
Figure 11:
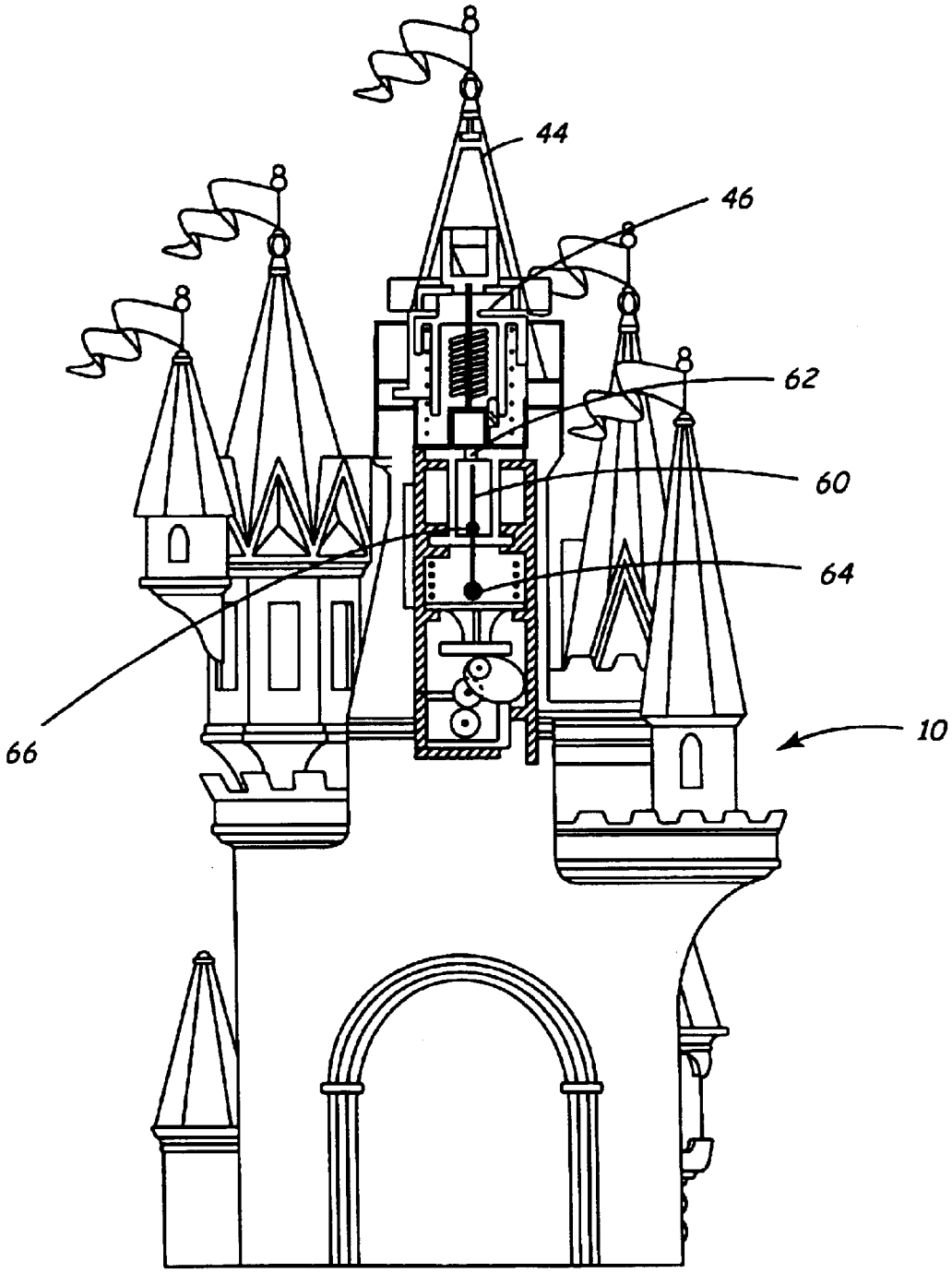
FIG. 11 is front, partially sectional view illustrating a launching mechanism and gravity pin, consistent with the principals of the present invention.
Figure 12:
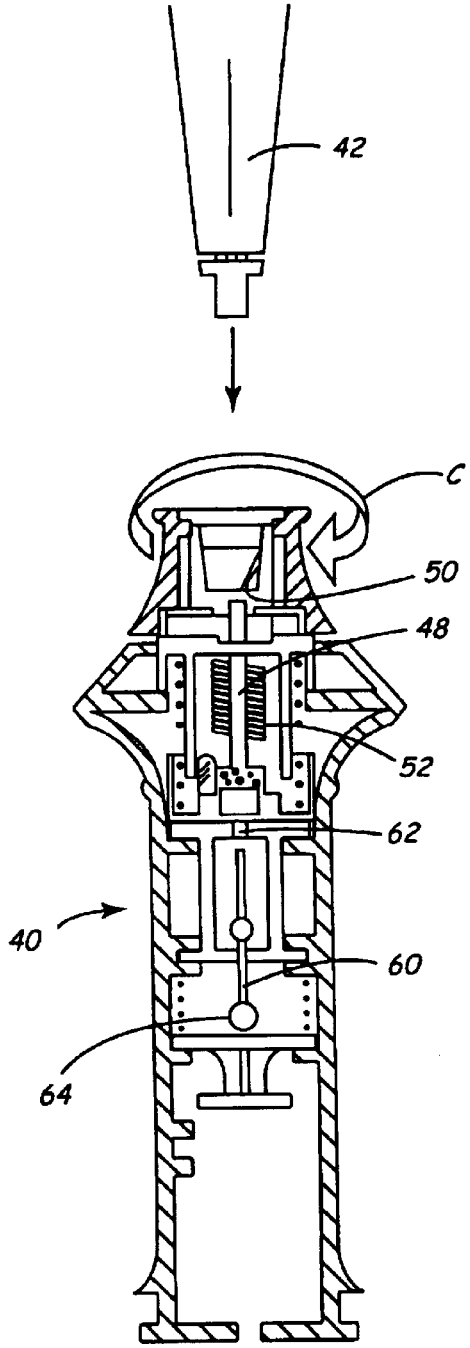
FIGS. 12–13 illustrate the coupling of a launchable doll while cooperating with the gravity pin of FIG. 11.

Referring to FIGS. 10A and 10B, the operator couples figurine 42 to wind up mechanism 46. After releasing wind up mechanism 46, figurine 42 is propelled upwards as indicated by Arrow A and rotates as indicated by Arrow B. Wings 58 may be provided on figurine 42 and may move from the position illustrated in FIG. 10A to that of FIG. 10B to further simulate flight. That is, figurine 42 is caused to rotate with wings 58 extended in a "helicopter" fashion. The distance flown or thrusted will depend upon the characteristics of wind up mechanism 46. In one embodiment, figurine 42 is launched between 2 to 8 inches in the direction of arrow A. In another embodiment, figurine 42 is launched between 3 to 6 inches in the direction of arrow A.

To launch figurine 42, the operator may use wand 70. Wand 70 may be configured to transmit an IR signal that is received by play set 10 so as to trigger the launch of figurine 42. Alternatively, wand 70 may serve as a key that is physically coupled with a trigger mechanism 41 on play set 10 (or on launch turret 40 if separated from play set 10) to launch figurine 42. Alternatively, a button or other mechanism 41 can simply be provided on play set 10 to initiate the launch.

Figure 13:
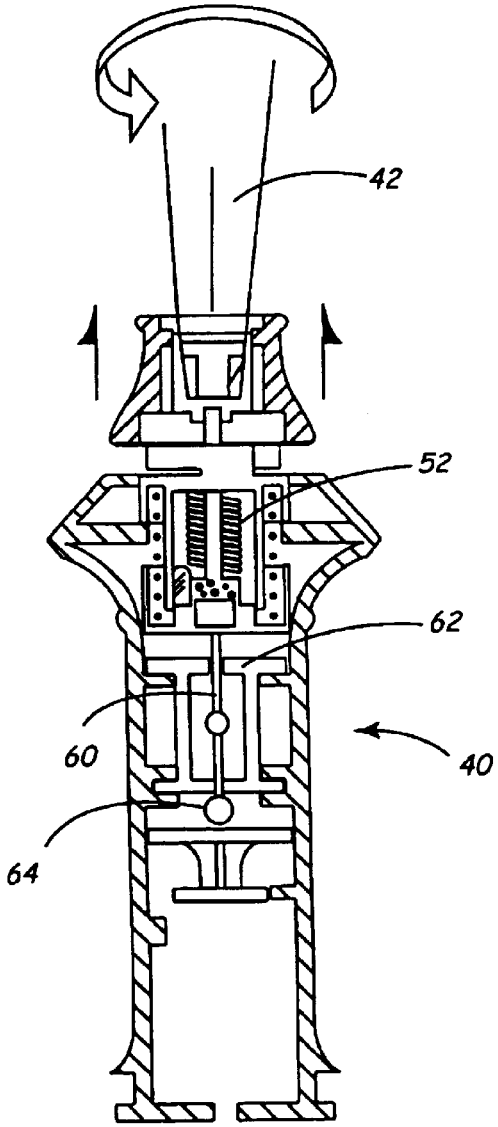
Figure 14:
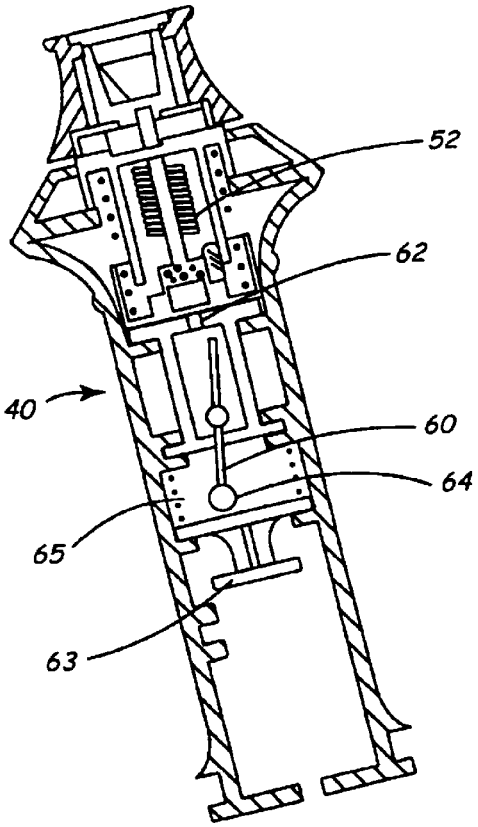
FIGS. 14–15 illustrate the proper and improper alignment of the gravity pin of FIG. 11.
Figure 15:
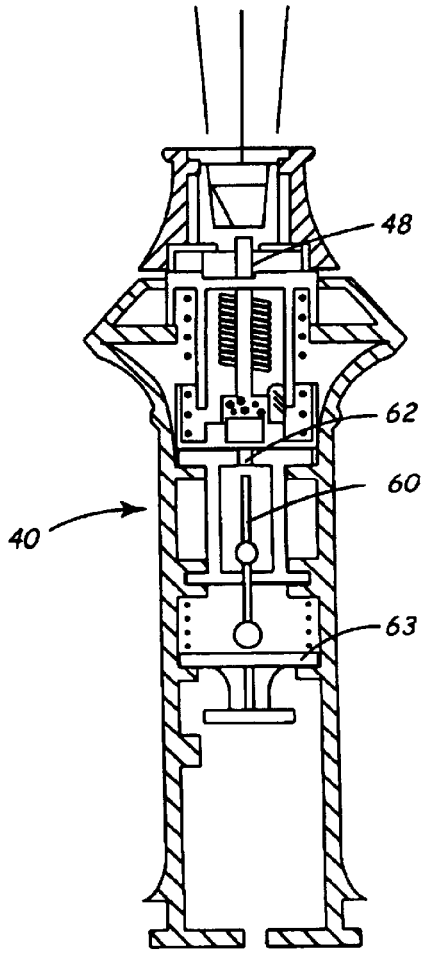

Referring to FIGS. 11–15 it may be desirable to prevent the premature launch of figurine 42 when play set 10 is tilted or angled by the operator. To prevent a premature launch from occurring, gravity pin 60 is provided. Gravity pin 60 is an elongated shaft having a weighted portion 64 at one end and a medially disposed pivot point 66. Only when vertically aligned can gravity pint 60 pass through pin slot 62 and allow figurine 42 to couple with foot peg holder 50 to begin the loading process. When angled, as in FIG. 14, gravity pin 60 is tilted and unable to pass through pivot slot 62 thus preventing movement relative to base 63. As illustrated in FIG. 13, when gravity pin 60 aligns with slot 62 and passes therethrough, base 63 and turret 40 move relative to one another, compressing secondary spring 65.

Figure 16:
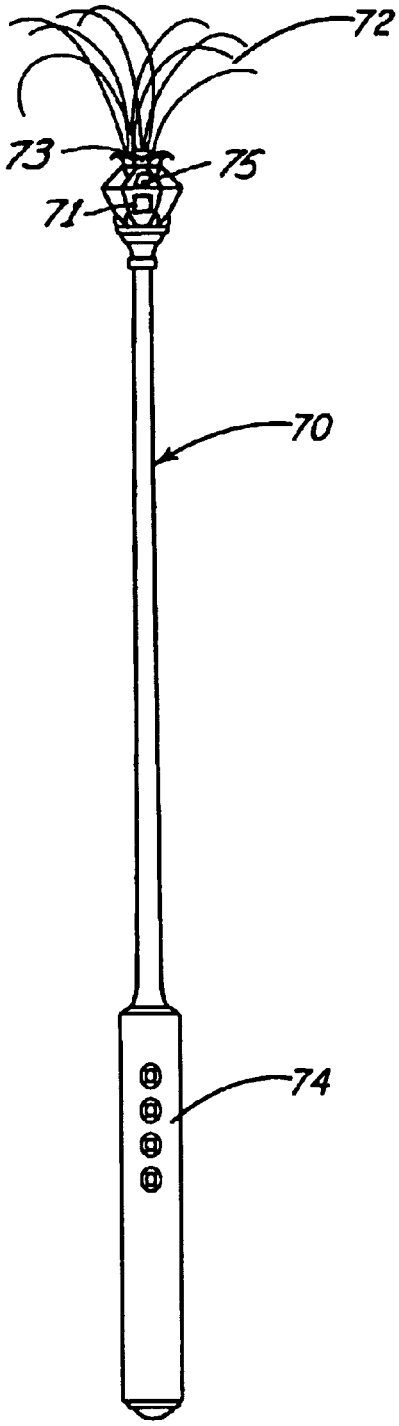
FIG. 16 illustrates a wand consistent with the principals of the present invention.

FIG. 16 is a top planar view of one embodiment of a wand 70. Wand 70 can serve a variety of functions. For example, wand 70 can be designed to correlate to the overall theme of play set 10. Additionally, wand 70 can serve as a triggering device to initiate the launch of figurine 42. In one embodiment, wand 70 acts as a key that is received within play set 10 to physically trigger the launch. Various mechanisms can be employed to facilitate the use of wand 70 as a key. For example, a magnet 71 could be utilized to activate a switch. Alternatively, a portion 73 of wand 70 could be shaped to be received by a corresponding "key hole" 41 on play set 10. Once so received any type of switch or activation can be employed to initiate the launch. In another embodiment, wand 70 acts as a triggering device by including an IR (infrared) transmitter 75. Play set 10 is provided with an IR receiver 41. When an appropriate signal is received by play set 10, the launch is initiated. An appropriate circuit and switching mechanism is provided within play set 10. As illustrated, wand 70 may include controls 74 that can either be decorative in nature, or when used as an IR transmitter 75 serve to transmit an appropriate signal. In addition, wand 70 may include further decorative elements such as fiber optics 72 that may optionally be illuminated. An appropriate power source, such as one or more batteries may be provided within wand 70 when acting as an IR transmitter 75 and/or to power a light source (not shown) to illuminate fiber optics 72 and/or controls 74.

Figure 17:
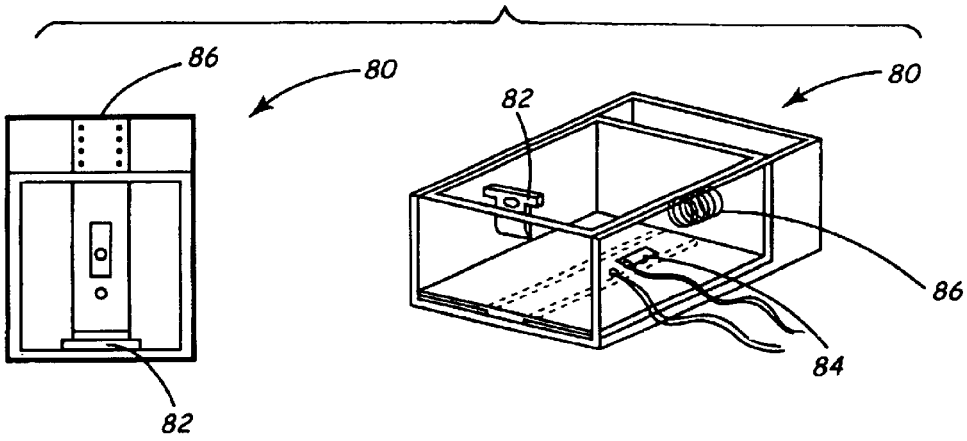
FIGS. 17–18 illustrate a secret compartment containable within the thematic play set, consistent with the principals of the present invention.
Figure 18:
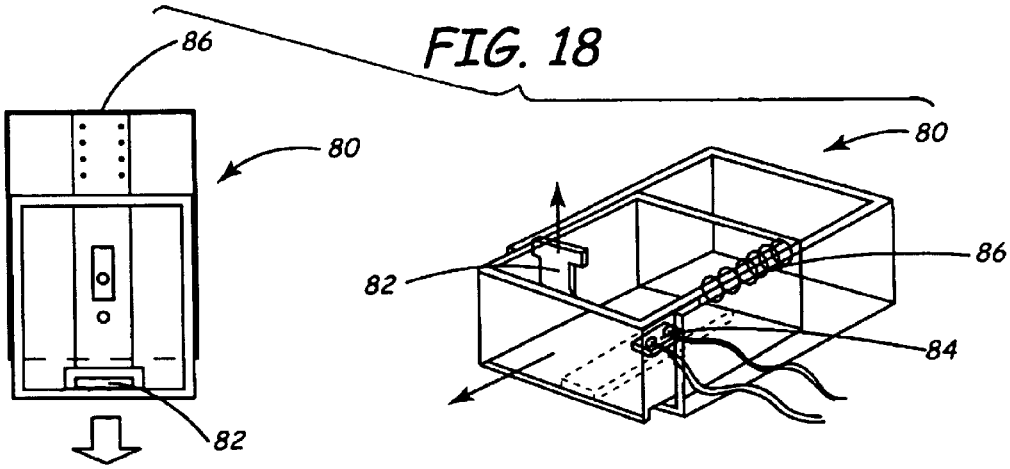

FIGS. 17 and 18 illustrate a compartment 80 that can be provided on or within play set 10. Compartment 80 includes a metal locking tab 82 that restrains compartment 80 from opening. A spring 86 is provided that biases compartment 80 towards the open position (FIG. 18). Thus, when locking tab 82 is lifted (as illustrated), compartment 80 opens. Compartment 80 may be readily visible or it may be a "secret" compartment designed to blend into play set 10.

To open play set 10, locking tab 82 can be externally accessible or can be coupled with a switch or lever that is externally accessible. Alternatively, locking tab 82 may not be externally accessible and a magnetic key may be provided to lift locking tab 82. The magnetic key can be incorporated into wand 70 and in fact the same type of magnetic key can be utilized to launch figurine 42. Alternatively, a magnetic key can be provided in another accessory that is consistent with the theme established by play set 10. Compartment 80 can be used for any number of purposes and an additional accessory or prize may be placed within compartment 80 for discovery by the user.

Compartment 80 also includes a contact switch 84 that is closed when compartment 80 is opened. Contact switch 80 can trigger various events such as the illumination of various lights or the actuation of a sound recording.

Play set 10 can be formed with any type of theme. As illustrated play set 10 has a castle theme. A wide variety of accessories can be provided consistent with a given them. For example, play set 10 can include a "pool" that may be filled with water; a container for bubble making solution; a bubble maker; chalk; jewelry or other props; various creatures or animal characters such as butterflies; nets or other props to play with the creatures or characters; a tea set including a teapot, cups and plates that can be stacked to blend with or form a portion of play set 10; or various other objects.

Figure 19:
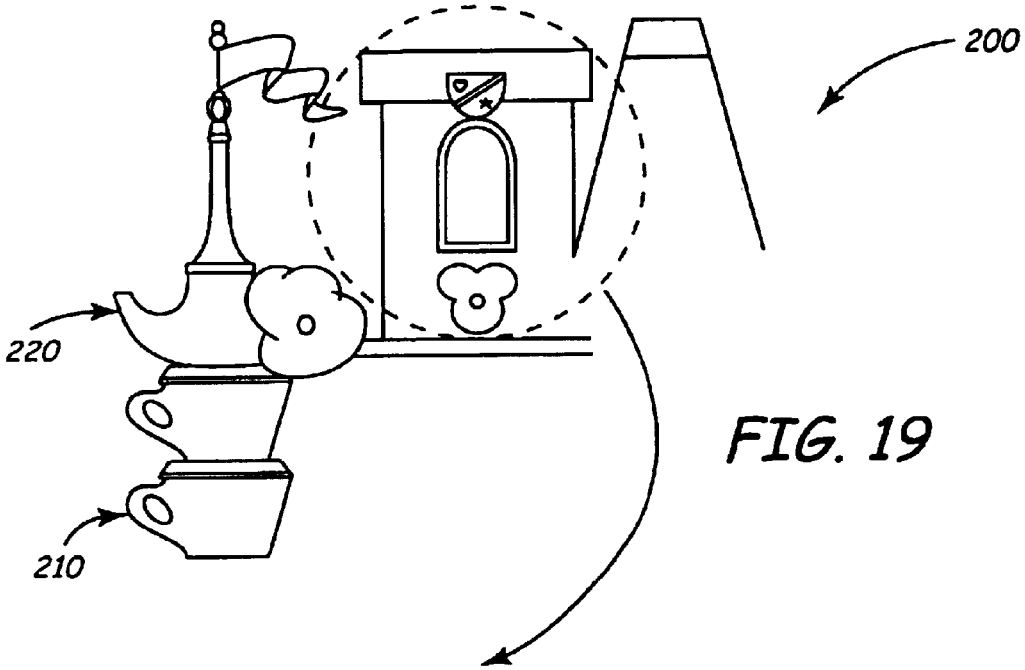
FIG. 19 is a side elevational view illustrating a turret consistent with the principals of the present invention.
Figure 20:
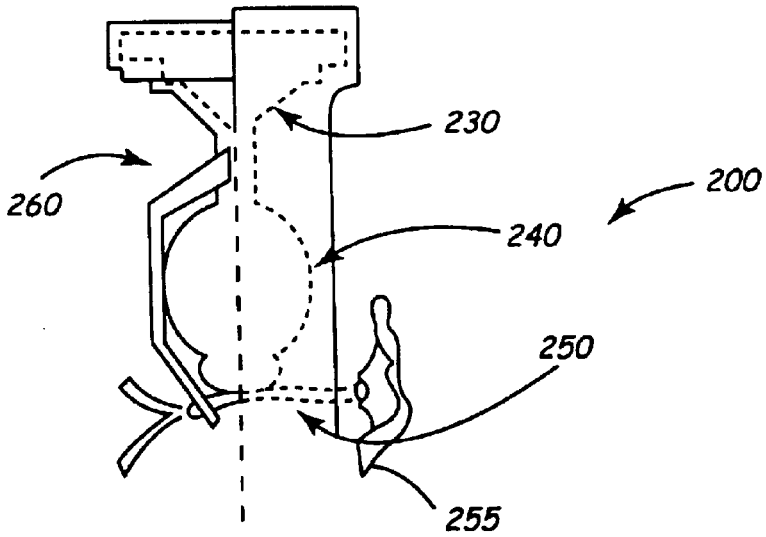
FIG. 20 is a side, partially sectional view illustrating a turret consistent with the principals of the present invention.

FIG. 19 is a partial side elevational view of a turret 200. Adjacent turret 200 are a pair of tea cups 210 and a teapot 220 that stack together to form a portion of castle 12. FIG. 20 is a side sectional view of turret 200. Turret 200 includes a funnel 230 operatively coupled to bladder 240. Bladder 240 is a compressible element made from a suitable material, such as PVC. A pull cord 250 runs proximate bladder 240 between a pull handle 250 and a cantilever 260. Thus, as pull cord 250 is pulled, cantilever 260 is caused to compress bladder 240. The compression of bladder 240 causes a rush of air out through funnel 230. Thus, for amusement purposes, various items can be placed within funnel 230 and blasted out by pulling on pull cord 250. For example, butterflies or other representative or whimsical creatures, objects or characters can be launched out of funnel 230 to stimulate flight. These creatures, objects or characters can be formed from cloth or other suitable lightweight material to facilitate their launch.

Although the present invention has been described with reference to various embodiments, persons skilled in the art will recognize that changes may be made in form and detail without departing from the spirit and scope of the invention.

We claim:

1. A play set comprising:

a thematic structure wherein the thematic structure is a castle;

a turret associated with the castle, the turret having a removable cap and a shaft;

a fireworks simulation comprising a fiber optic bundle within the shaft, the fiber optic bundle configured to be moveable between a retracted position wherein the bundle is disposed within the shaft and an extended position wherein a portion of the bundle is external to the shaft; and a launcher associated with the castle.

2. The play set of claim 1, further comprising a light source coupled with the fiber optic bundle.

3. The play set of claim 2, further comprising a contact switch positioned within the shaft and engageable through movement of the fiber optic bundle to engage the light source.

4. The play set of claim 1, further comprising a lever coupled with the fiber optic bundle and external to the shaft so that movement of the lever causes movement of the fiber optic bundle.

5. A play set comprising:

a thematic structure wherein the thematic structure is a castle having a turret;

a fireworks simulation associated with the castle; and a launcher that forms a portion of the turret, wherein the launcher includes a wind up mechanism for storing energy to launch an object away from the play set.

6. The play set of claim 5, wherein the launcher includes a foot peg holder for receiving the object.

7. The play of claim 5, wherein the wind up mechanism includes at least one spring to cause the wind up mechanism to spin the object.

8. The play set of claim 6, further comprising:

a gravity pin located within the turret which prevents the foot peg holder from receiving the object if the turret is not approximately vertically aligned.

9. The play set of claim 5, wherein the object includes wings.

10. The play set of claim 5, wherein the launcher includes an activation mechanism.

11. The play set of claim 10, further comprising a wand wherein elements of the activation mechanism are located at the launcher and at the wand.

12. The play set of claim 5, wherein the launcher further comprises a motor to wind the wind up mechanism.

13. A play set comprising:

a thematic structure wherein the thematic structure is a castle;

a tubular shaft coupled with the structure, formed within a turret, and integrated with the theme; and a fiber optic bundle moveable from a first position wherein the fiber optic bundle is substantially contained within the tubular shaft to a second position wherein a substantial portion of the fiber optic bundle is outside of the tubular shaft.

14. The play set of claim 13, further comprising a light source coupled to one end of the fiber optic bundle.

15. The play set of claim 13, further comprising a lever coupled with the fiber optic bundle for moving the fiber optic bundle between the first and second position.

16. The play set of claim 13, wherein the turret includes a removable cap that covers one end of the fiber optic bundle when the fiber optic bundle is in the first position.

17. A play set comprising:

a thematic structure;

a launching mechanism coupled with the thematic structure, the launching mechanism including:

a receiving slot for receiving a launchable object;

a gravity pin that prevents the coupling of the object to the launching mechanism unless the launching mechanism is substantially vertical;

a wind up mechanism for storing energy to launch the object; and an activation mechanism for causing the wind up mechanism to launch the object.

18. The play set of claim 17, wherein the launching mechanism includes at least one spring for storing energy to cause the object to spin when launched.

19. The play set of claim 17, further comprising a motor for engaging the wind up mechanism.

20. The play set of claim 17, further comprising a handheld device wherein elements of the activation mechanism are located at the launcher and at the handheld device.

21. The play set of claim 17, wherein the theme is a castle and the launcher is incorporated into a turret of the castle.

22. The play set of claim 21, wherein the launcher is separable from the castle.

23. A thematic play set, comprising:

a castle structure;

means for simulating a fireworks bloom;

means for launching a figurine; and means for remotely triggering the means for launching the figurine.

24. The play set of claim 23, further comprising means for illuminating the fireworks bloom.

25. The play set of claim 23, wherein the means for launching the figurine include means for rotating the figurine.

26. The play set of claim 23, further comprising:

a storage compartment within the castle structure; and means for opening the storage compartment.

27. The play set of claim 23, further comprising means for expanding the castle structure.

28. A play set comprising:

an interactive thematic building; and a fireworks simulation associated with the building, wherein the fireworks simulation is a fiber optic bundle, the fiber optic bundle configured to be moveable between a retracted position wherein the bundle is disposed within a shaft associated with the building and an extended position wherein at least a portion of the bundle is external to the shaft, wherein the fireworks simulation is further configured to vary between displayed and hidden.

29. The play set of claim 28 further comprising a launcher associated with the building, wherein the launcher includes a wind up mechanism configured to launch an object away from the play set.

30. The play set of claim 29 wherein the launcher includes an activation mechanism, wherein the activation mechanism is an IR transmitter and an IR receiver, wherein the IR receiver is coupled with the launcher.

31. The play set of claim 30 further comprising a wand wherein the wand houses the IR transmitter.

32. The play set of claim 30 wherein the activation mechanism includes a key switch that is activated by an external key.

33. The play set of claim 28 further comprising a compartment configured to form a portion of the building, the compartment comprising:

a spring biasing the compartment toward an open position; and a latch for securing the compartment in a closed position.

34. A play set comprising:

a thematic structure wherein the thematic structure is a castle having a turret;

a fireworks simulation associated with the castle; and a launcher that forms a portion of the turret, the launcher having a wind up mechanism for storing energy to launch an object away from the play set.

35. The play set of claim 34, wherein the launcher includes a foot peg holder for receiving the object.

36. The play Set of claim 35, further comprising:

a gravity pin located within the turret which prevents the foot peg holder from receiving the object if the turret is not approximately vertically aligned.

37. The play set of claim 34, wherein the wind up mechanism includes at least one spring to cause the wind up mechanism to spin the object.

38. The play set of claim 34, wherein the object includes wings.

39. The play set of claim 34, wherein the launcher includes an activation mechanism.

40. The play set of claim 34, further comprising a wand wherein elements of the activation mechanism are located at the launcher and at the wand.

41. The play set of claim 34, wherein the launcher further comprises a motor to wind the wind up mechanism.

42. The play set of claim 33 wherein the latch is metal, the play set further comprising a magnetic key configured to lift the latch to open the compartment.

* * * * *